US005433036A

United States Patent [19]

Ganal

[11] Patent Number: 5,433,036

[45] Date of Patent: Jul. 18, 1995

[54] WINGED PICTURE FRAME STAND

[76] Inventor: Nicael B. Ganal, 94-075 Awamoku St., Waipahu, Hi. 96797

[21] Appl. No.: 181,796

[22] Filed: Jan. 18, 1994

[51] Int. Cl.[6] ..... G09F 1/12

[52] U.S. Cl. ..... 40/152.1; 40/159

[58] Field of Search ..... 40/152.1, 159, 377, 40/405, 493, 661, 124.2, 606; 211/163, 169; 403/300, 305

[56] References Cited

U.S. PATENT DOCUMENTS

| | | | |
|---|---|---|---|
| 890,886 | 6/1908 | Woelz | 40/493 |
| 1,527,024 | 2/1925 | Brookbank | 40/493 |
| 2,725,221 | 12/1956 | Olson | 40/606 X |
| 3,635,352 | 1/1972 | Brooks et al. | 40/377 X |
| 3,959,903 | 6/1976 | Schneider | 40/377 |
| 4,745,695 | 5/1988 | Hetzer | 40/661 |
| 5,160,050 | 11/1992 | Russo | 211/169 X |
| 5,323,553 | 6/1994 | Candido | 40/661 X |

*Primary Examiner*—Brian K. Green
*Attorney, Agent, or Firm*—Michael I. Kroll

[57] ABSTRACT

A winged picture frame stand is provided, which consists of a structure for displaying in a vertical radial arrangement a plurality of pictures, advertisements and similar articles. The structure can sit upon a flat horizontal surface to accomplish the displaying.

3 Claims, 2 Drawing Sheets

WINGED PICTURE FRAME STAND

BACKGROUND OF THE INVENTION

1. Field of the Invention

The instant invention relates generally to display holders and more specifically it relates to a winged picture frame stand.

2. Description of the Prior Art

Numerous display holders have been provided in prior art that are adapted to exhibit information which can be placed upon a horizontal surface or mounted against a vertical surface. While these units may be suitable for the particular purpose to which they address, they would not be as suitable for the purposes of the present invention as heretofore described.

SUMMARY OF THE INVENTION

A primary object of the present invention is to provide a winged picture frame stand that will overcome the shortcomings of the prior art devices.

Another object is to provide a winged picture frame stand in which sets of transparent wing members for holding a plurality of pictures, advertisement and similar articles can be stacked one upon the other to take up a limited amount of space for viewing.

An additional object is to provide a winged picture frame stand in which each set of transparent wing members that are radially supported upon a vertical shaft retained in a base can be rotated thereabout for better viewing.

A further object is to provide a winged picture frame stand that is simple and easy to use.

A still further object is to provide a winged picture frame stand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
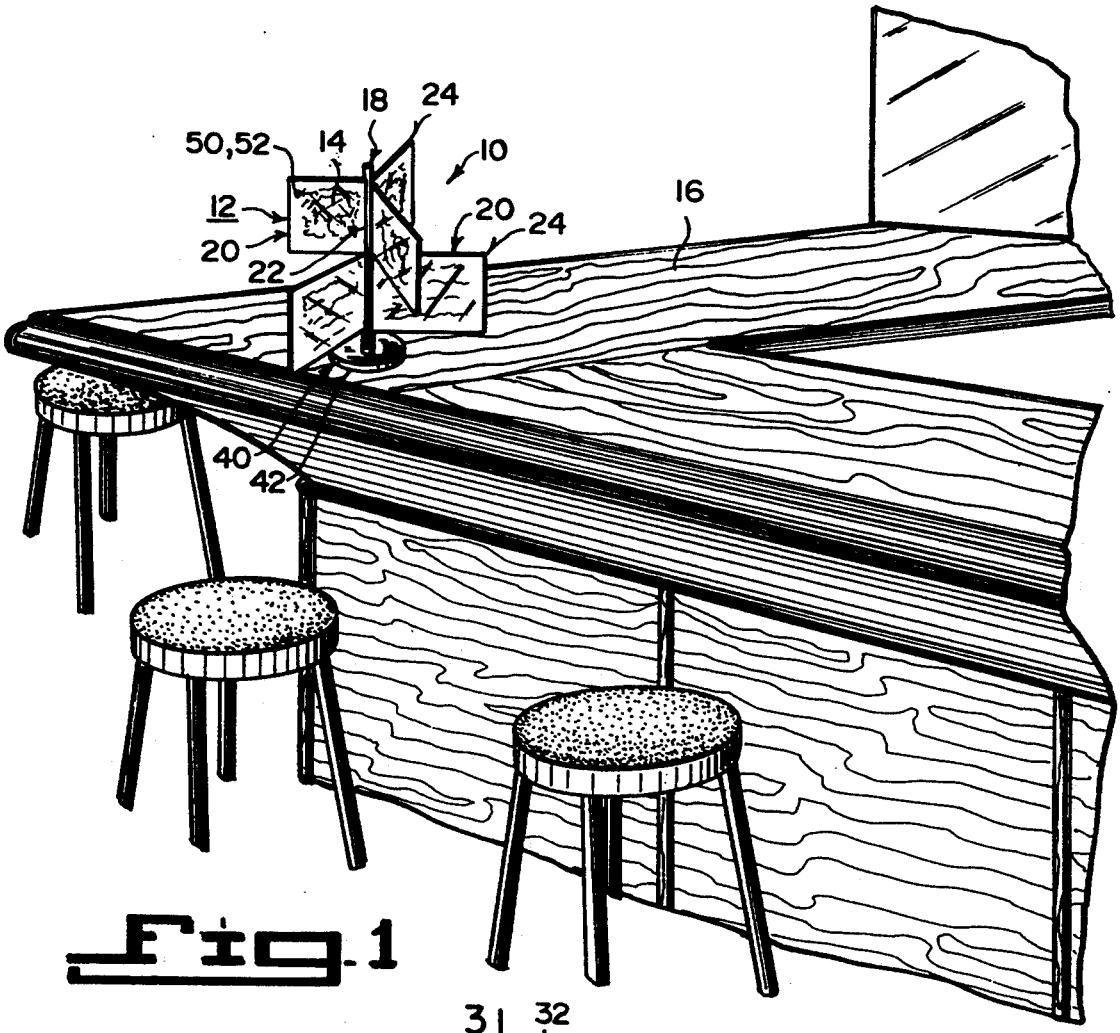
FIG. 1 is a perspective view of a first embodiment of the instant invention in use placed upon a counter.
Figure 2:
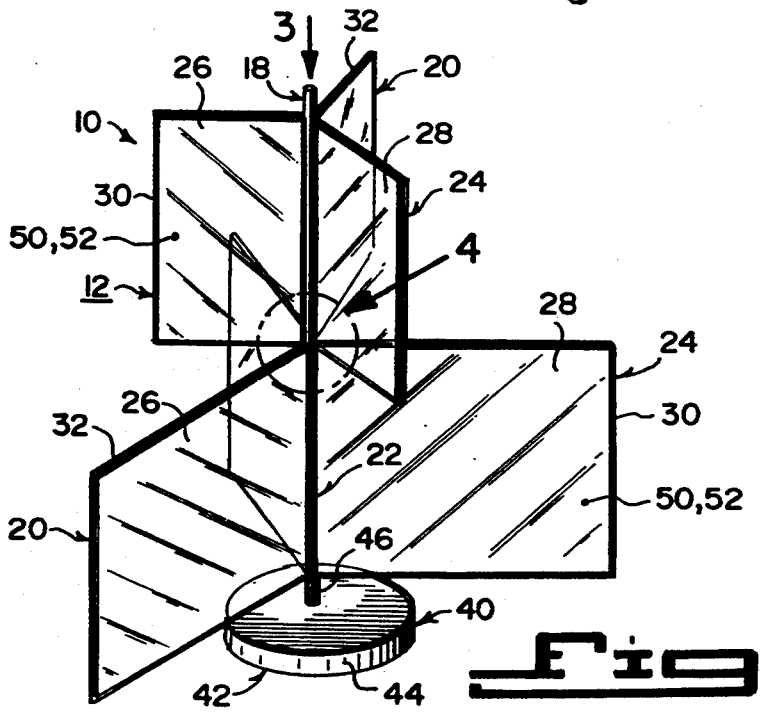
FIG. 2 is an enlarged perspective view of the first embodiment per se.
Figure 3:
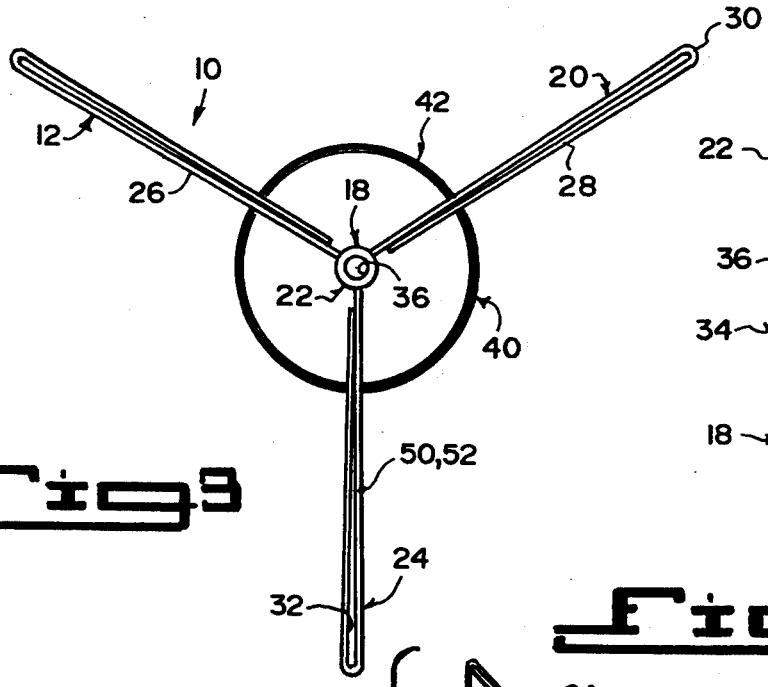
FIG. 3 is a top view taken in the direction of arrow 3 in FIG. 2.
Figure 4:
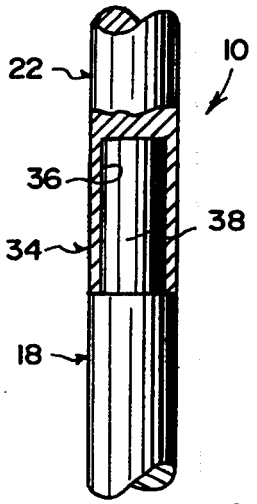
FIG. 4 is an enlarged elevational view with parts broken away and in section as indicated by arrow 4 in FIG. 2.
Figure 5:
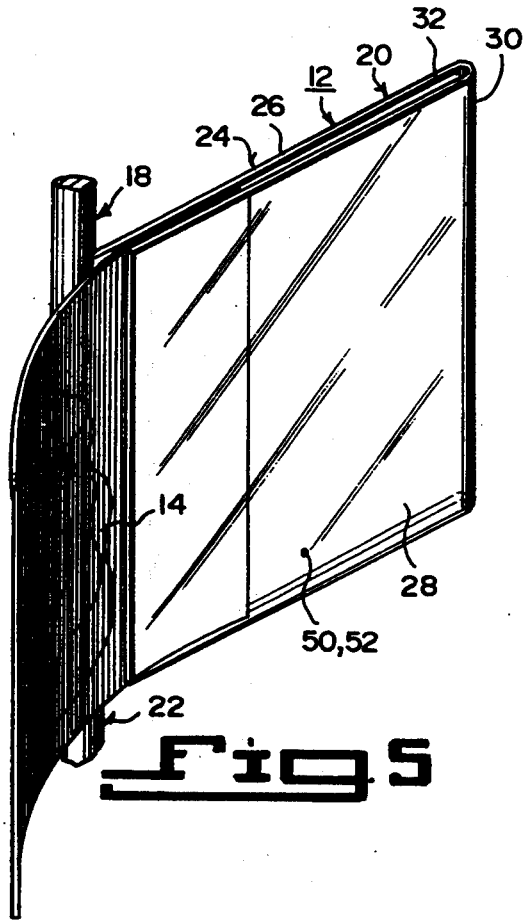
FIG. 5 is a perspective view of a portion of the first embodiment showing a picture being inserted into one of the transparent wing members.
Figure 6:
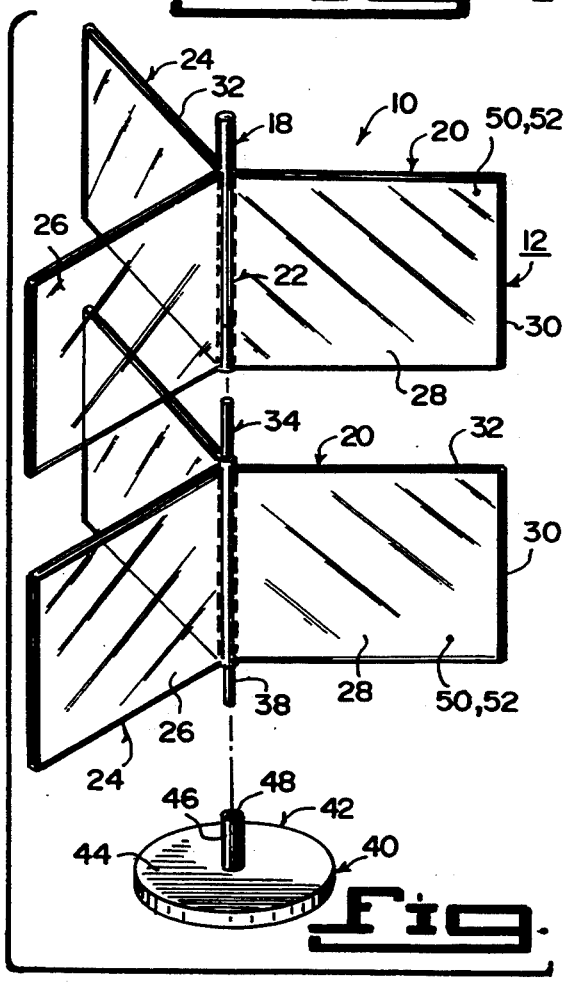
FIG. 6 is an exploded perspective view of a second embodiment of the instant invention.

Turning now descriptively to the drawings, in which similar reference characters denote similar elements throughout the several views, FIGS. 1 through 6 illustrate a winged picture frame stand 10, which consists of a structure 12 for displaying in a vertical radial arrangement a plurality of pictures, advertisements and similar articles 14. The structure 12 can sit upon a flat horizontal surface 16, such as a counter to accomplish the displaying.

The displaying structure 12 includes an upright support member 18. Components 20 are affixed about the upright support member 18 for retaining the plurality of pictures, advertisement and similar articles 14 in a vertical array, so that the pictures, advertisements and similar articles can be viewed therefrom.

The upright support member 18 is a cylindrical stanchion 22. The retaining components 20 are a plurality of transparent wing members 24, extending from a common center of the cylindrical stanchion 22.

Each transparent wing member 24 contains a first panel 26, affixed along one side to the cylindrical stanchion 22. A second panel 28 is integral to the first panel 26 and has a folded edge 30. The second panel 28 will be pressed against the first panel 26, forming a slotted pocket 32 to receive one picture, advertisement and similar article 14 therein.

The winged picture frame stand 10 further includes elements 34, for stacking a plurality of the cylindrical stanchions 22 one upon the other, to increase the amount of the transparent wing members 24 for viewing, whereby the cylindrical stanchions 22 can be rotated thereabout. The stacking elements 34 consists of each cylindrical stanchion 22 having a bore 36 extending into a top and bottom end. A plurality of pins 38 are provided, with each sized so that one half of the pin 38 will fit into the top bore 36 in one cylindrical stanchion 22 and into the bottom bore 36 in another cylindrical stanchion 22.

A housing 40 is for retaining the lowermost cylindrical stanchion 22 upon the flat horizontal surface 16, to allow the lowermost cylindrical stanchion 22 to rotate thereabout. The retaining housing 40 is a pedestal-shaped base 42. The pedestal shaped base 42 consists of an enlarged weighted disc-shaped foot 44. A shank 46 extends upwardly from the center of the foot 44. The shank 46 has a top bore 48, to receive one half of one pin 38 extending from the bottom bore 36 of the lowermost cylindrical stanchion 22.

Each transparent wing member 24 can be fabricated out of an acrylic plastic material 50, or a fiberglass material 52.

Dimensions for the various parts of the winged picture frame stand 10 are typically, but not limited to:

1. The diameter of each cylindrical stanchion 22 being one half inch in diameter.
2. Each transparent wing member 24 being five inches in height and three and one half or seven inches in length.
3. Each first panel 26 and second panel 28 being one sixteenth of an inch in thickness.
4. Each bore 36 being five sixteenths in diameter and one and one half inches in depth.
5. Each pin 38 being nine thirty-seconds in diameter and three inches in length.
6. The foot 44 being five inches in diameter and three eights of an inch in thickness.
7. The shank 46 being one and one half inches in length.
8. The top bore 48 being five sixteenths in diameter and one and one half inches in depth.

| LIST OF REFERENCE NUMBERS | |
|---|---|
| 10 | winged picture frame stand |
| 12 | displaying structure |
| 14 | picture, advertisement and similar article |
| 16 | flat horizontal surface |
| 18 | upright support member |
| 20 | retaining component |
| 22 | cylindrical stanchion for 18 |
| 24 | transparent wing member |
| 26 | first panel |
| 28 | second panel |
| 30 | folded edge |
| 32 | slotted pocket |
| 34 | stacking elements |
| 36 | bore in 22 |
| 38 | pin |
| 40 | retaining housing |
| 42 | pedestal-shaped base |
| 44 | enlarged weighted disc-shaped foot |
| 46 | shank |
| 48 | top bore in 46 |
| 50 | acrylic plastic material for 24 |
| 52 | fiberglass material for 24 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A winged picture frame stand in combination with a plurality of transparent wing members, the plurality of transparent wing members for displaying a plurality of pictures, advertisements and similar articles, said frame stand comprising base means for resting on a flat, horizontal surface, cylindrical stanchion mounted at one end on said base means and extending vertically upwards, said stanchion including means for supporting said transparent wing members extending in different planes from a common center of said cylindrical stanchion, each said transparent wing member including first and second panels with only an edge of the first panel affixed along one side to said cylindrical stanchion and said second panel integral to said first panel and having a free unattached folded edge, said second panel being pressed against said first panel forming a slotted pocket to receive one picture, advertisement or similar article therein, and means for stacking a plurality of said cylindrical stanchions one upon the other, to increase the amount of said wing members for viewing, whereby said cylindrical stanchions can be rotated thereabout to rearrange independently the positions of said wing members for each of said stanchions, each said cylindrical stanchions having a bore extending into a top and bottom end, and a plurality of pins, each sized so that one half of said pin will fit into said top bore in one said cylindrical stanchion and into said bottom bore in another said cylindrical stanchion, and said base means comprising an enlarged weighted disc-shaped foot and a shank extending upwardly from said foot, said shank having a top bore to receive one half of one said pin extending from said bottom bore of one of said cylindrical stanchions.

2. A winged picture frame stand as recited in claim 1, wherein each said transparent wing member is fabricated out of acrylic plastic material.

3. A winged picture frame stand as recited in claim 1, wherein each said transparent wing member is fabricated out of fiberglass material.

* * * * *